US006016890A

United States Patent [19]

Whitmer

[11] Patent Number: 6,016,890

[45] Date of Patent: Jan. 25, 2000

[54] PERSONAL SAFETY DEVICE

[76] Inventor: Gerald T. Whitmer, Rte. 1, Box 33, Shenandoah Junction, W. Va. 25442

[21] Appl. No.: 09/210,030

[22] Filed: Dec. 11, 1998

Related U.S. Application Data

[63] Continuation-in-part of application No. 09/118,298, Jul. 17, 1998.

[51] Int. Cl.[7] ..... E06C 7/18

[52] U.S. Cl. ..... 182/36; 248/228.3

[58] Field of Search ..... 182/3, 36; 248/228.1–228.5

[56] References Cited

U.S. PATENT DOCUMENTS

| | | | |
|---|---|---|---|
| 1,616,275 | 2/1927 | Olsen | 248/228.1 |
| 2,548,248 | 4/1951 | Wiebe . | |
| 2,675,201 | 4/1954 | Friel . | |
| 3,217,833 | 11/1965 | Smith | 182/3 |
| 3,232,393 | 2/1966 | Attwood | 248/228.6 |
| 5,673,888 | 10/1997 | Garguilo | 248/228.3 |
| 5,711,397 | 1/1998 | Flora | 248/228.3 |

FOREIGN PATENT DOCUMENTS

| | | | |
|---|---|---|---|
| 1235840 | 3/1967 | Germany | 248/228.2 |

*Primary Examiner*—Alvin Chin-Shue

[57] ABSTRACT

Fall protection devices that can be attached with one hand to pre-existing structural members while working at elevated levels are described. Such devices comprise a generally U-shaped member having a long and a short leg, a spring-loaded plunger mechanism which serves to lock a movable retainer bar in a position to securely engage a pre-existing structural member, and an attachment point for a lanyard or other fall prevention device. A positive locking mechanism for the spring loaded plunger is also described.

4 Claims, 7 Drawing Sheets

PERSONAL SAFETY DEVICE

This application is a continuation-in-part of U.S. patent application Ser. No. 09/118,298, filed Jul. 7, 1998, in the name of Gerald T. Whitmer for "Personnel Safety Device".

FIELD OF THE INVENTION

The present invention relates to devices that permit personnel to secure themselves for safety purposes when working in elevated situations. More specifically the present invention describes devices suitable for safely securing personnel during hull cleaning or repair operations inside the hulls of ships, in large tanks, or in other situations where attachment of safety devices is made to T-shaped beams or inverted angle structural portions of the structure being worked on or within.

BACKGROUND OF THE INVENTION

When performing repair or cleaning operations at elevated levels, Federal Law and good common sense require that personnel be properly secured or "tied-off" to prevent injury in the event of a fall. In many situations, particularly those encountered inside the hulls of ships or in large tanks, where work may be being performed at elevations as much as or more than 35 feet from the floor, it is often difficult to locate appropriate attachment points for securing protective fall prevention devices.

In such situations, inside ship hulls, it is common to use so-called "mouse holes" in the structure of the vessel as attachment points for safety straps or cables. Since these "mouse holes" are designed to provide weep holes for contained cargo or water and not as attachment points for safety lanyards, they are often rough and result in fraying and concomitant weakening of inserted nylon straps or cables. Additionally, their location is sporadic, and they are often not located in appropriate positions to permit satisfactory and safe securement of safety lines. Also, the attachment of appropriate such nylon or cable safety lines to the "mouse holes" requires the use of both hands. Thus, the installer must let go of the ladder or other device by which he reached the level of the securing point in order to attach the safety line. This situation poses the immediate, albeit temporary, risk of falling with no protective fall prevention device in place.

The personnel security devices of the present invention, on the other hand, are designed to attach to regularly spaced, preexisting, structural members of a ship's hull or tank with one hand without the risk of damaging the strap or cable being used as a fall prevention tool.

SUMMARY OF THE INVENTION

The present invention relates to personnel safety devices that provide fall protection for individuals working in elevated positions. More specifically, the present invention describes a novel device for the attachment of fall prevention equipment to the interior of the hulls of ships that are undergoing maintenance or repair. The novel devices of the present invention are designed for attachment to the interior, existing structure of the ship's hull with one hand so that no temporary risk of injury is posed during the period of attachment of the security device to the hull.

DETAILED DESCRIPTION OF THE INVENTION

Figure 1:
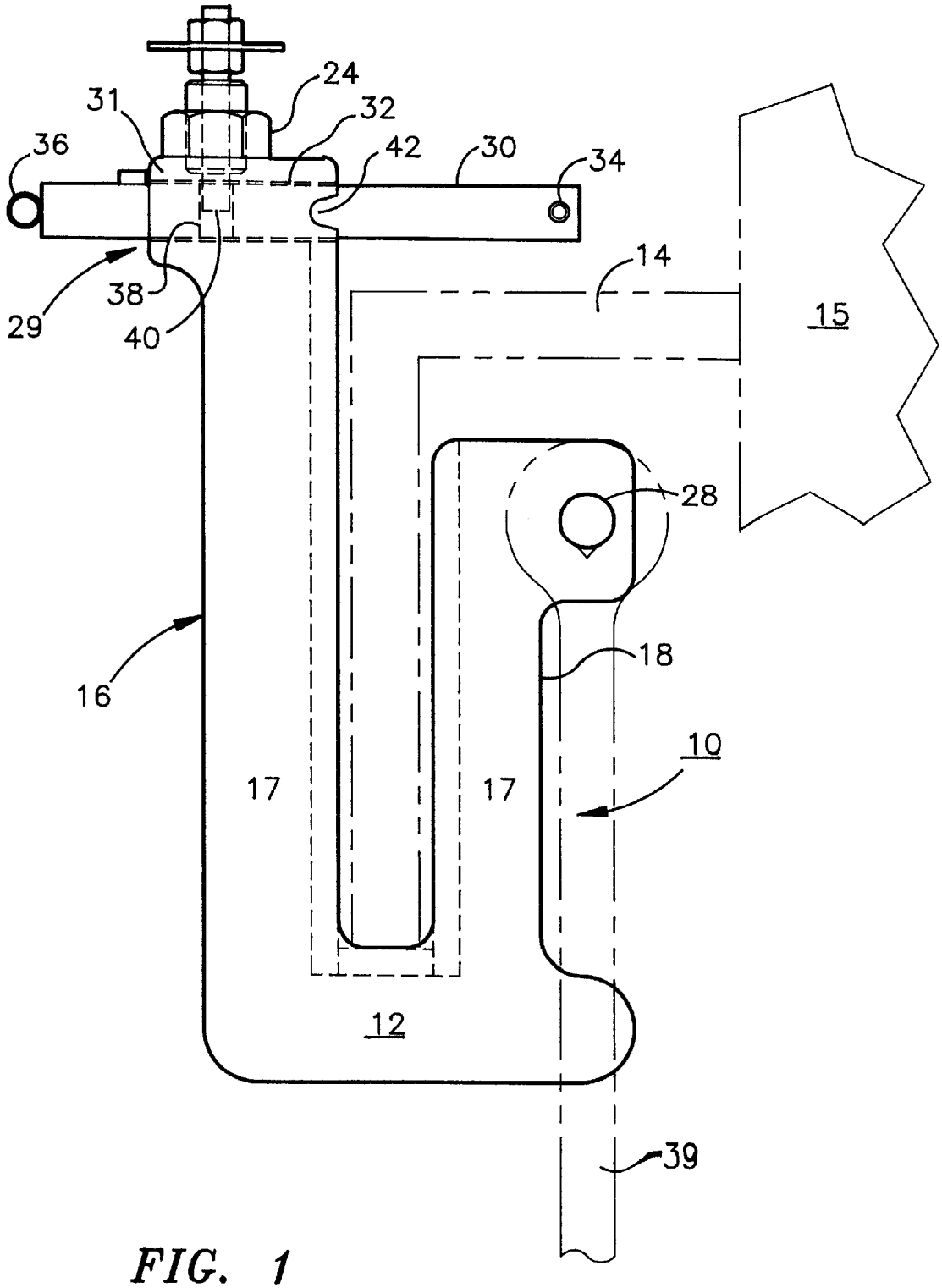
FIG. 1 is a side view of one preferred embodiment of the safety device of the present invention.

Throughout the following detailed description, similar reference numerals refer to similar elements in all Figures of the drawings.

As shown in the drawings, the safety device of the present invention is embodied in two preferred embodiments both of which comprise a generally U-shaped member having a long and a short leg, a spring-loaded plunger which serves to retain a mechanism or retainer bar which secures the device to an appropriate hull structural member, and a point for attaching a lanyard or other fall prevention device.

Figure 2:
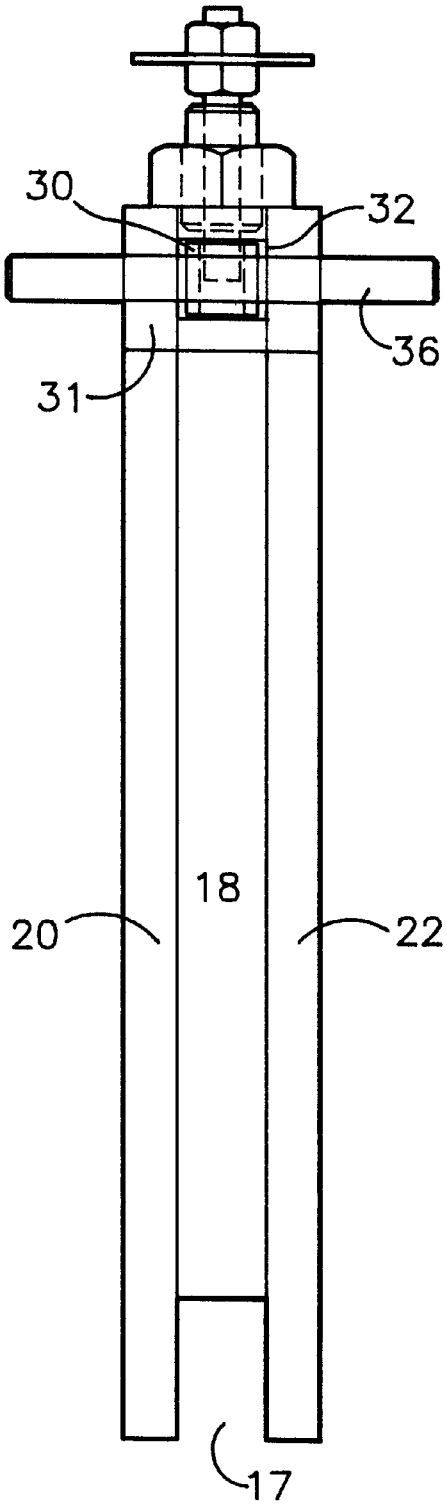
FIG. 2 is an end view of the safety device of FIG. 1.
Figure 3:
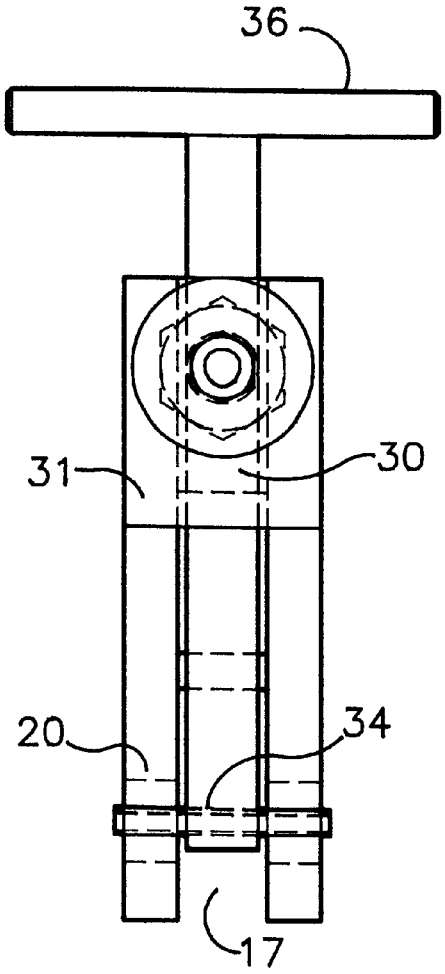
FIG. 3 is a top view of the safety device of FIG. 1.
Figure 8:
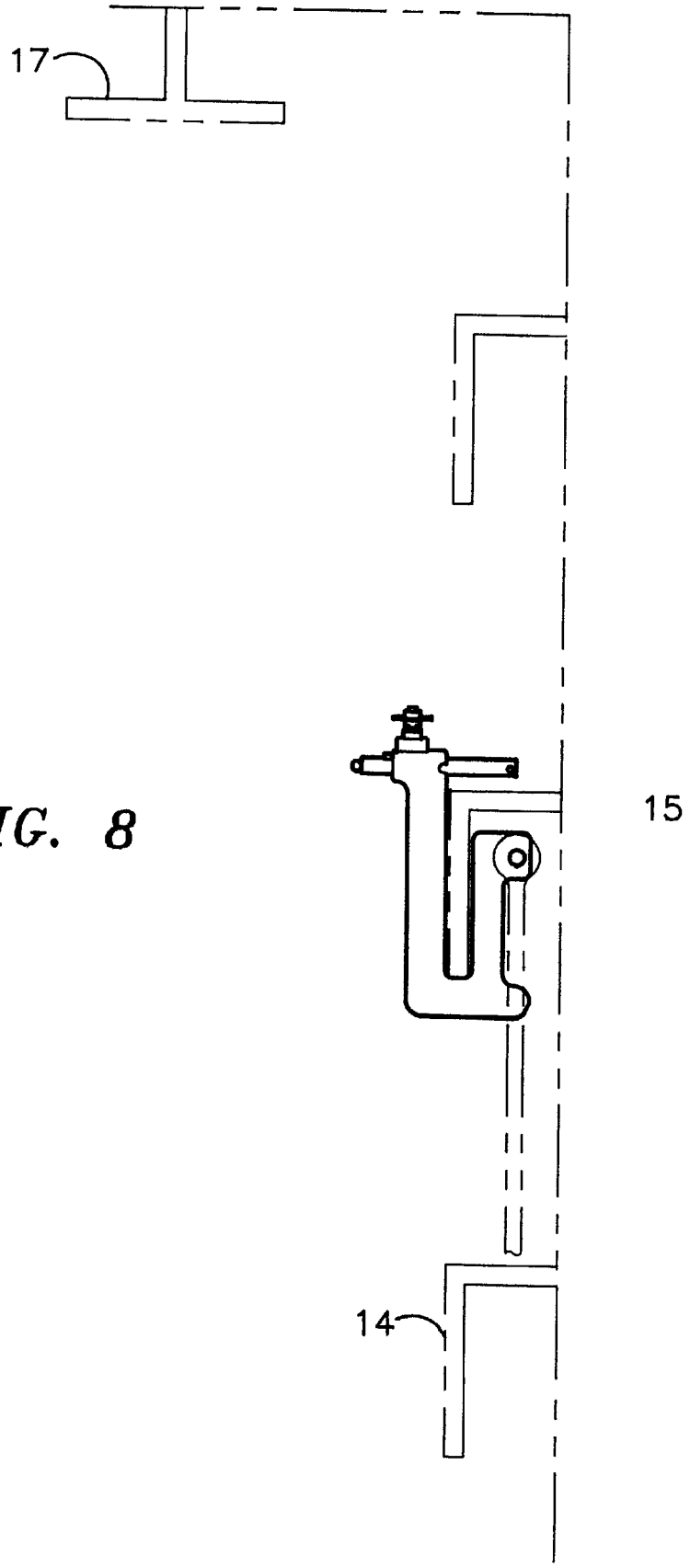
FIG. 8 is a schematic, cross-sectional view of the interior of a ship's hull showing a T-beam and inverted angles to which the safety device of the present invention can be attached.

As shown in FIG. 1, the first embodiment of the safety device 10 of the present invention comprises a generally U-shaped member 12 which is designed to engage and fit over an inverted angle 14 attached to hull 15. The typical location of inverted angles 14 in hull 15 is shown in FIG. 8. Generally U-shaped member 12 has a long leg 16 and a short leg 18. As best shown in FIGS. 2 and 3, U-shaped member 12 preferably has a channel 17 formed by sides 20 and 22 which extends about the entire periphery thereof except where the plunger assembly 24 and retainer bar 30, both described in detail hereinafter, are located. The purpose of this channel, in addition to lightening the device of the present invention, will be described in greater detail below. Located on short leg 18 is a safety line attachment point 26. Safety line attachment point 26 comprises a pin, bolt or other shaft 28 which is secured in any desired fashion between walls 20 and 22 of U-shaped member 12. According to a preferred embodiment, safety line attachment point 26 comprises a bolt that penetrates walls 20 and 22 through appropriately located holes (not shown). The use of a bolt in this case permits fast and easy installation and removal of a lanyard or other safety strap or cable from the safety device either before or after use.

At the extremity of long leg 16 is retainer assembly 29. Retainer assembly 29 comprises a plunger assembly 24 and a retainer bar 30. Retainer bar 30 slideably penetrates the solid extremity 31 of long leg 16 through passage 32 and is equipped with a restraining pin 34 which prevents it from falling out of passage 32, as well as a grip 36 for assisting with detachment thereof upon removal from the ship's structure or other securing point as described hereinafter. Retainer bar 30 also has a hole or recess 38 therein suitable for receiving spring-loaded pin 40 of plunger assembly 24 upon proper and complete orientation thereof in a securing position.

Plunger assembly 24 may be of any suitable design so long as spring-loaded pin 40 is oriented and powered by the spring to engage hole or recess 38 when retainer bar 30 is slid forward for installation. Installation is accomplished by engaging long leg 16 and short leg 18 with inverted structural member 14, as shown, and pushing retainer bar 30 forward until spring-loaded pin 40 engages hole or recess 38 in retainer bar 30 whereupon safety attachment device 10 is locked into place. Removal is accomplished by disengaging spring-loaded pin 40 from hole 38 by pulling outward on plunger pin 40 and withdrawing retainer bar 30 until restraining pin 34 once again engages recess 42.

As will be apparent to the skilled artisan, when a lanyard or other appropriate securing device 31 is attached to attachment point 26 by fastening to shaft 28, it will tend to be pulled into channel 17 thereby providing some lateral stabilization for lanyard 31, and maintaining the downward pulling force on safety device 10 in a relatively constant position.

The particular design and construction of plunger assembly 24 is relatively unimportant so long as its structure and the spring are adequate to accomplish the required engagement of plunger pin 40 with hole or recess 38 and to support the weight of an individual falling.

Safety devices of this type constructed from ⅜" A-36, T-1 and A-66 steels have been tested to in excess of 5000 lbs. pulling pressure without failure. The retainer bar in this embodiment is preferably ⅝" steel.

Figure 4:
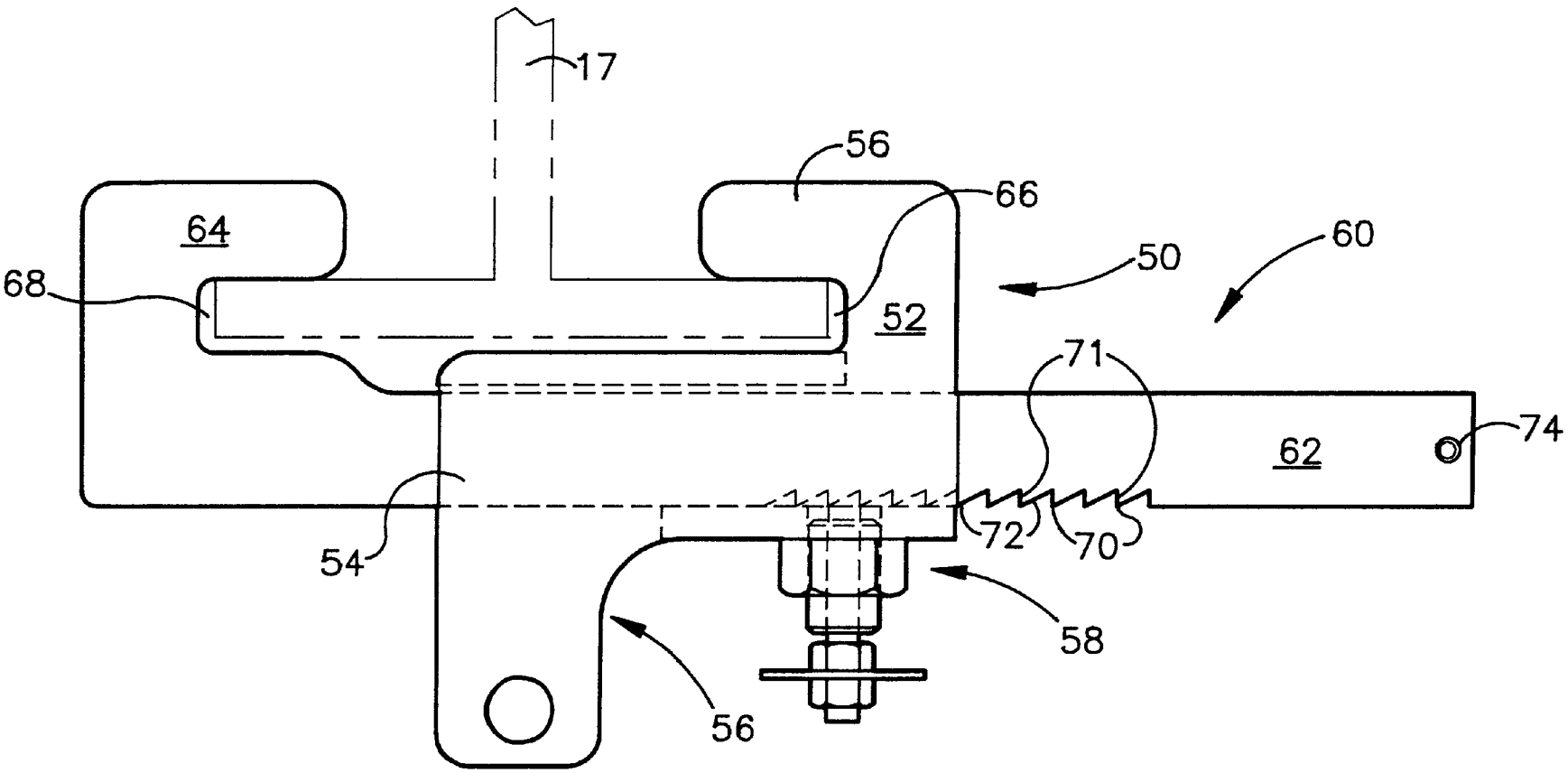
FIG. 4 is a side view of an alternate preferred embodiment of the safety device of the present invention.
Figure 5:
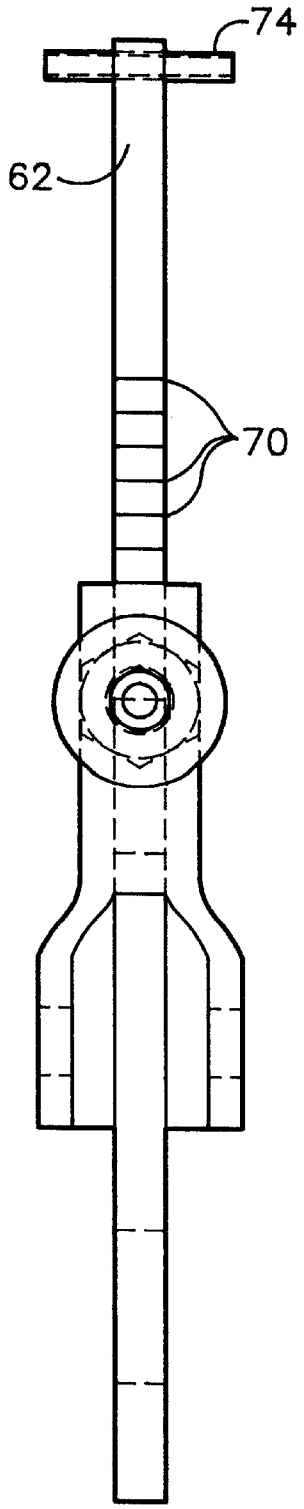
FIG. 5 is a side view of the safety device of FIG. 4.

A second preferred embodiment of the device of the present invention is depicted in FIG. 4. As shown in FIG. 4, the safety device 50 comprises a generally U-shaped member 52 having a long leg 54 and a short leg 56. Plunger assembly 58 is located at the base of long leg 54 on that side of long leg 54 furthest removed from short leg 56. Safety line attachment point 57 is located at the outer extremity of long leg 54 on the same side thereof as plunger assembly 58. In this embodiment, retainer bar 60 is generally U-shaped, has a long leg 62 and a short leg 64 and is slideably inserted through the interior of long leg 54 of safety device 50 such that the open end 66 of generally U-shaped member 52 faces the open end 68 of generally U-shaped retainer bar 60. Stated in another fashion, the short leg of retainer bar 60 faces short leg 56 of generally U-shaped member 50. On the surface of long leg 62 of retainer bar 60 which abuts plunger assembly 58 are serrations or gear teeth 70.

Figure 7:
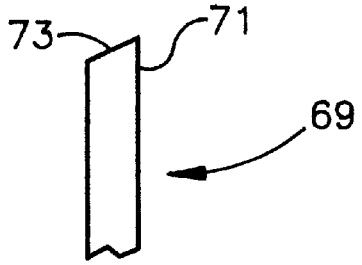
FIG. 7 is a detailed view of the tip of the plunger mechanism of the present invention.
Figure 6:
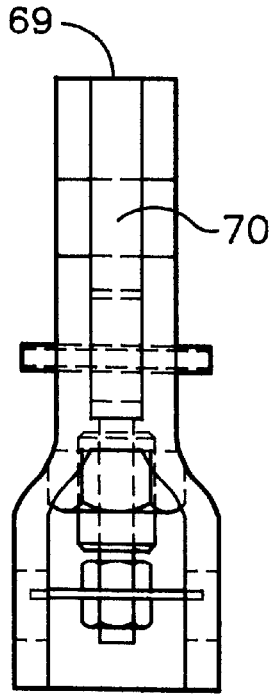
FIG. 6 is a top view of the safety device of FIG. 4.

Plunger assembly 58 is of the same general configuration as previously described plunger assembly 24 with a single major exception. This difference is that the tip 69 of spring-loaded pin 73 of plunger assembly 58 is of an angular design that matches the serrations or gear teeth 70. Thus, each of gear teeth 70 has a flat or "square" side 71 and a "slanted" or angled side 72. Similarly, tip 69 of spring-loaded pin 70 has a flat or "square" side and a "slanted" or angled side designed to engage the matching design of gear teeth 70. This design is shown most clearly in FIG. 7. As shown in this Figure, tip 69 has a flat side 75 and an angular side 73. The shape of tip 69 is a mirror image of any individual gear tooth 70. Thus, since the angled side of tip 69 engages the angled sides 72 of gear teeth 70, retainer bar 60 can be slid past tip 69 with the spring loading of spring-loaded pin 70 permitting tip 69 to "bounce" from one gear tooth 70 to another when retainer bar 60 is pushed inward or toward tip 69, but the flat or square side of tip 69 will engage the flat sides 71 of gear teeth 70 when removal is attempted, and removal without disengagement of tip 69 from teeth 70 by retraction of spring-loaded pin 70 of plunger assembly 58 is not possible.

Preferably, retainer bar 60 has a restraining pin 74 to prevent its accidental or inadvertent removal during installation or handling.

The design of safety line attachment point 57 is generally of the same configuration as that of safety line attachment point 26 described hereinabove.

In use, short leg 56 of safety device 50 is applied to one leg of T beam 17 and retainer bar 60 pushed inward toward spring-loaded plunger assembly 58 until short leg 64 of retainer bar 60 engages the second leg of T beam 17. In this configuration, teeth 70 and tip 69 prevent removal. Removal is accomplished by pulling outwardly on plunger assembly 58 to disengage tip 69 from contact with teeth 70 and withdrawing retainer rod 60 until safety device 50 is disengaged from T beam 17.

The materials of construction and dimensions of this device are generally the same as those described above for the earlier embodiment. In this case, however, the retainer bar 60 is fabricated from ⅜" steel. Similar force testing of this device produced similar satisfactory results.

Figure 9:
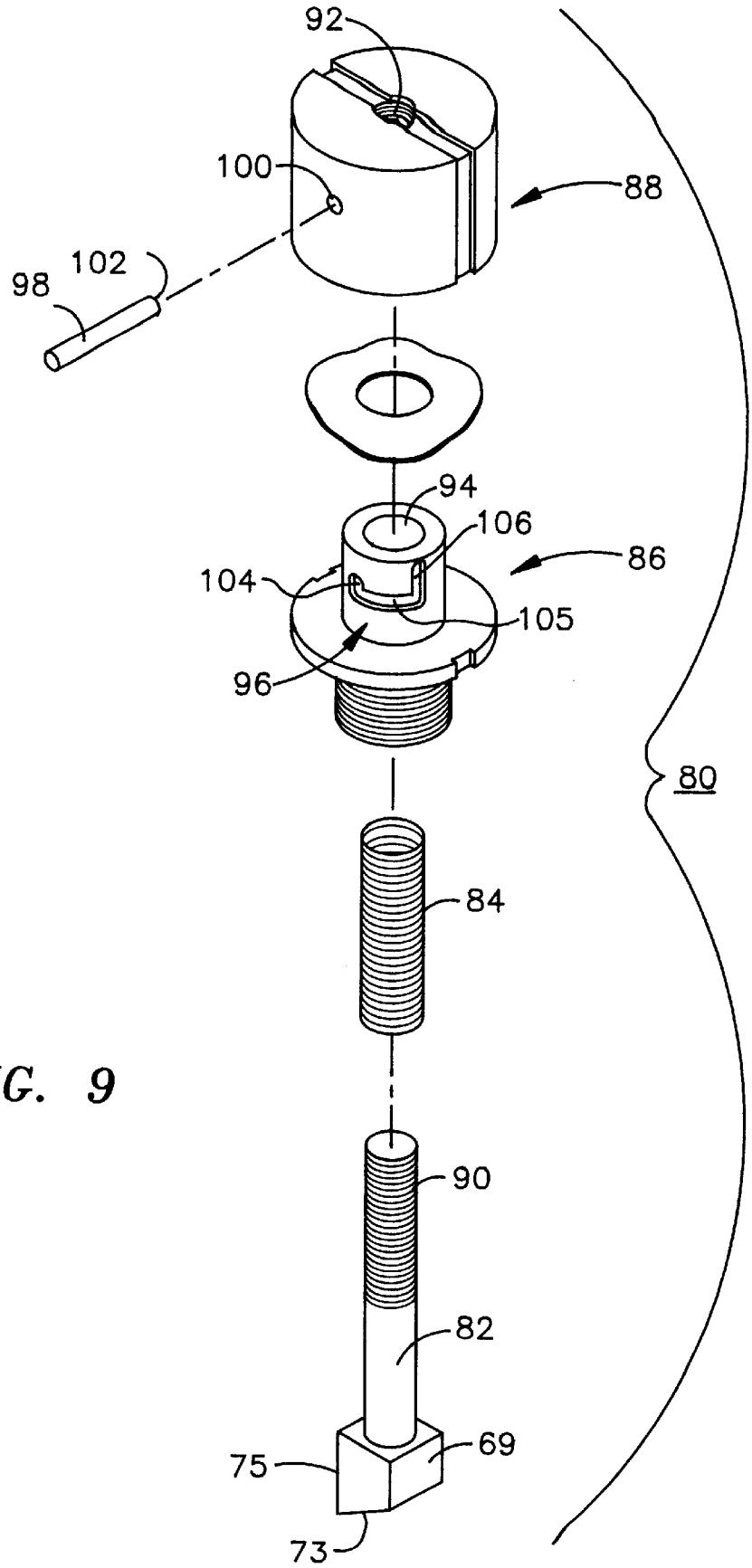
FIG. 9 is a blown apart view of a preferred embodiment of the plunger assembly of FIG. 7.
Figure 10:
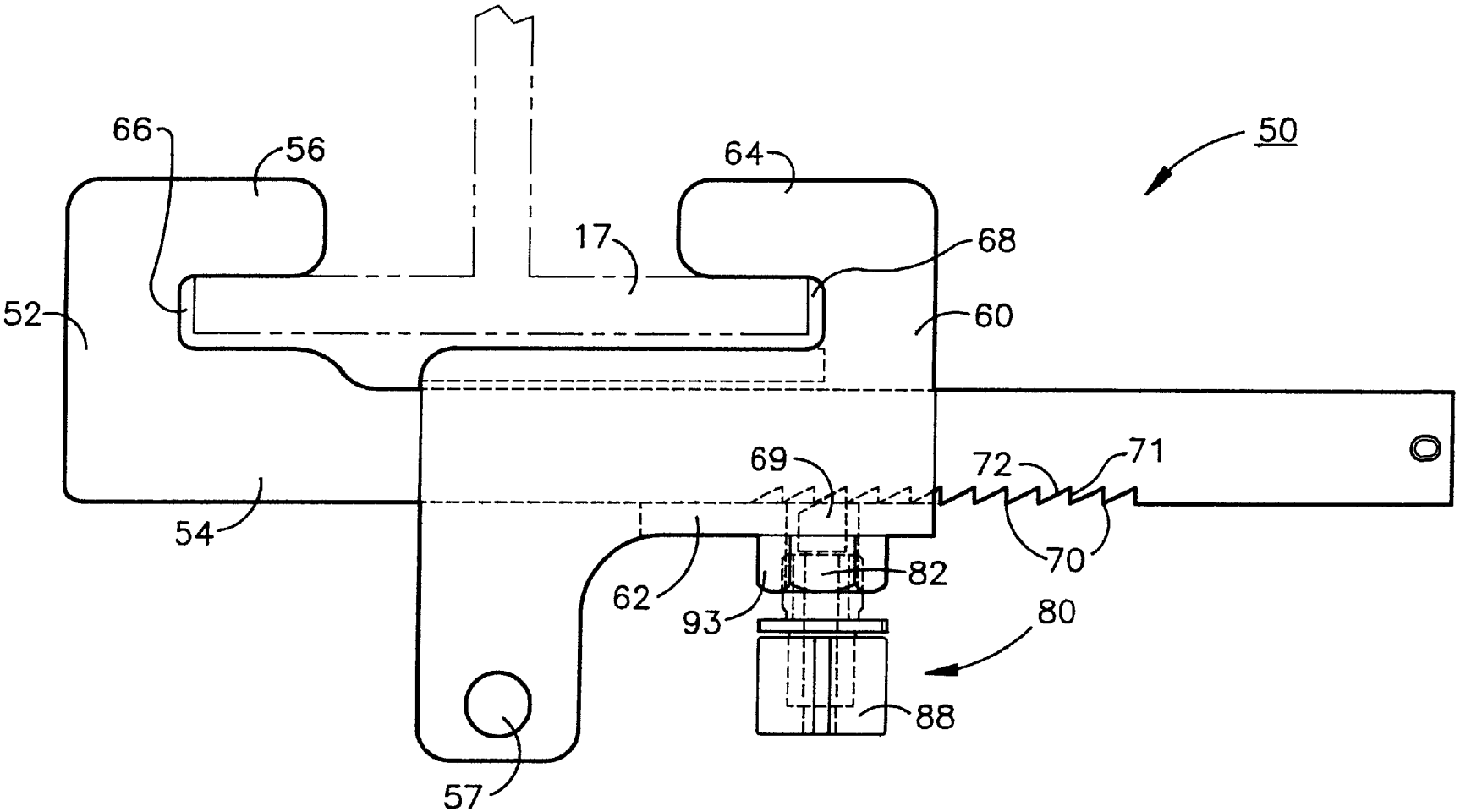
FIG. 10 is a side view of a second embodiment of the safety device of FIGS. 4–6 incorporating the plunger assembly of FIG. 9.

According to yet another highly preferred embodiment, plunger assembly 58 is provided with a locking mechanism as depicted in FIGS. 9 and 10. As shown in FIG. 9, according to this embodiment a locking spring-loaded plunger assembly 80 is provided to prevent even accidental disengagement of safety device 50. In accordance with this embodiment, locking spring-loaded plunger assembly 80 comprises a pin 82 having an angular tip 69 as described hereinabove, a spring 84 about the periphery of pin 82 which serves to springingly load pin 82 against retainer 86 and a locking nut 88. Pin 82 is provided with threads 90 which are sized to engage threads 92 on the interior of locking nut 88. Threads 91 on the exterior of retainer 86 engage attachment nut 93 and hold the entire spring loaded plunger assembly 80 in place.

Assembly is accomplished by placing spring 84 about pin 82, inserting pin 82 through aperture 94 in retainer 86 and engaging threads 90 and 92. Aperture 94 is sized to accept passage of pin 82 while providing a stop for spring 84. Retainer 86 includes, on its periphery, a locking slot 96 which serves to engage a locking pin 98 that is inserted into aperture 100 in locking nut 88 after assembly. Locking pin 98 is of such a length that tip 102 of locking pin 98 engages locking slot 96 in the assembled configuration. In the embodiment shown in FIG. 9, a spring washer 104 is shown between retainer 86 and locking nut 88. Spring washer 104 is desirable to maintain pressure, but it is not critical to the successful practice of the present invention. While locking pin 98 is depicted as a simple pin in the drawings, it will be apparent to the skilled artisan that a screw or other similar device could be substituted therefor, so long as the functionality, as described hereinafter is maintained.

Since locking slot 96 has a short leg 104 and a long leg 106, the relative location of locking pin 98 in locking slot 96 will permit either loading or unloading of pin 82 depending upon the position of locking pin 98 in locking slot 96. When locking nut 88 is turned so that tip 102 of locking pin 98 engages long leg 106 of locking slot 96, pin 82 and attached tip 69 will be capable of being retracted from engagement with teeth 70 by pulling on locking nut 88. Conversely, when tip 102 of locking pin 98 engages short leg 104 of locking slot 96, retraction will not be possible and tip 69 will be firmly engaged with teeth 70 with no possibility of accidental retraction. Of course, turning of locking nut 88, and concurrently locking pin 98, is achieved by a slight inward pressure on locking nut 88 during the turning operation.

Central portion 105 of locking slot 96 allows transition from one position to the other of locking pin 98 within locking slot 96.

Although the use of a locking plunger assembly as just described is not mandatory for the successful practice of the present invention, its use is clearly preferred do to the increased safety factor that it provides.

Although this invention has been illustrated by reference to specific embodiments, it will be apparent to those skilled in the art that various changes and modifications may be made which clearly fall within the scope of the appended claims.

What is claimed is:

1. A personnel safety device comprising a generally U-shaped member having a long and a short leg, a spring-loaded plunger mechanism which serves to lock a movable retainer bar in a position to securely engage a pre-existing structural member, and an attachment point for a lanyard or other fall prevention device, wherein the long leg has a base and an extremity and the spring-loaded plunger mechanism is located at the extremity of the long leg of the generally U-shaped member and the short leg has a base and an extremity and the attachment point is located at the extremity of the short leg, wherein the attachment point comprises a shaft which transverses a gap in the generally U-shaped member.

2. The personnel safety device of claim 1 wherein the spring-loaded plunger assembly includes a pin and the movable retainer bar is slideably mounted through a passage in the extremity of the long leg below the plunger mechanism and said movable retainer bar includes a hole therethrough for engaging the pin when the movable retainer bar is fully extended in a position to securely engage a pre-existing structural member.

3. The personnel safety device of claim 2 further including, at both ends of the retainer bar, restraining means for preventing inadvertent removal of the retainer bar from the passage in the extremity of the long leg.

4. The personnel safety device of claim 2 including a channel about the entire periphery of said U-shaped member except for that portion occupied by the retainer bar and the plunger mechanism.

* * * * *